United States Patent [19]

Hoskinson et al.

[11] 4,299,153

[45] Nov. 10, 1981

[54] TOUCH RESPONSIVE ENVELOPE CONTROL FOR ELECTRONIC MUSICAL INSTRUMENT

[75] Inventors: William R. Hoskinson, Elburn; Joseph C. Carley, Sycamore, both of Ill.

[73] Assignee: The Wurlitzer Company, DeKalb, Ill.

[21] Appl. No.: 65,619

[22] Filed: Aug. 10, 1979

[51] Int. Cl.[3] ..... G10H 3/00; G10H 1/02

[52] U.S. Cl. ..... 84/1.1; 84/1.13; 84/1.26; 84/1.24

[58] Field of Search ..... 84/1.24, 1.26, 1.1, 84/1.13

[56] References Cited

U.S. PATENT DOCUMENTS

| | | | |
|---|---|---|---|
| 3,506,772 | 4/1970 | McNerney | 84/1.01 |
| 3,530,225 | 9/1970 | Gschwandtner | 84/1.13 |
| 3,588,310 | 6/1971 | Gschwandtner | 84/1.13 |
| 3,590,133 | 6/1971 | Schwartz et al. | 84/1.24 |
| 3,935,783 | 2/1976 | Machanian et al. | 84/1.21 |
| 3,937,115 | 2/1976 | Staley | 84/1.23 |
| 4,018,125 | 4/1977 | Nishimoto | 84/1.26 |
| 4,033,219 | 7/1977 | Deutsch | 84/1.26 |
| 4,067,253 | 1/1978 | Wheelwright et al. | 84/1.24 |
| 4,083,286 | 4/1978 | Faulkner | 84/1.24 |
| 4,095,502 | 6/1978 | Moore et al. | 84/1.26 |
| 4,099,439 | 7/1978 | Luce | 84/1.26 |
| 4,121,348 | 10/1978 | Niinomi et al. | 84/1.26 |
| 4,154,133 | 5/1979 | Kitawaga | 84/1.26 |

*Primary Examiner*—J. V. Truhe
*Assistant Examiner*—Forester W. Isen
*Attorney, Agent, or Firm*—Trexler, Bushnell & Wolters, Ltd.

[57] ABSTRACT

A touch responsive tonal envelope waveshape control system is provided for an electronic musical instrument which includes cooperating tone generating and keying circuits which are responsive to actuation of a key for initiating the generation and keying of a corresponding tone. The system of the invention includes encoding circuits responsive to the actuation of a key for producing encoded signals corresponding to the intensity of player actuation of the key and an amplitude control circuit responsive to these encoded intensity signals and cooperative with the keying circuits for controlling the peak amplitude of the tonal envelope waveshape in accordance with the intensity of player actuation of the key for initiating that tone.

14 Claims, 6 Drawing Figures

18
17
KEYBOARD SCANNER & ENCODER
19
CLOCKS
15
B-2 CHIP
11
13
12
14
SC
98
108
146
HI LOAD
42
106
110
VARIABLE IMPEDANCE
16
10
VREF 40
42
44
MUX 32
54
46
48
50
MUX 36
52
33
S
CLK SR
96
94
24
20a
20
22
28
30
TP
69
100
MUX 34
56
MUX 38
P
35
102
104
26
B+
FF
CLK
Q
R
90
SYS STROBE 70
84
86
74
76
CLK COUNTER RST
72
15
104
82
R1
R2
R3
R4
R5
R6
R7
R8
78
ANA-LOG MUX ST
OUT
80
88
HI LOAD
11
13
B-2 TONE GEN & KEYING CHIP
12
B+
B+
14
V REF

TOUCH RESPONSIVE ENVELOPE CONTROL FOR ELECTRONIC MUSICAL INSTRUMENT

BACKGROUND OF THE INVENTION

This invention relates generally to envelope generation in an electronic musical instrument, and more particularly to a system for touch-responsive generation of an envelope waveshape in an electronic musical instrument of the keyboard variety.

While it will become apparent from the ensuing discussion the present invention is useful in providing a touch-responsive envelope waveshape in conjunction with a number of electronic musical instruments the invention will be more particularly described with reference to a specific tone generator system. This tone generator comprises an LSI tone generating and keying circuit of the type disclosed in the copending U.S. patent application of Schwartz et al, Ser. No. 917,313, filed June 20, 1978, now U.S. Pat. No. 4,203,337, and assigned to The Wurlitzer Company. This LSI tone generating and keying circuit or chip will be hereinafter referred to as a B-2, in conformity with its nomenclature in the aforementioned copending application.

Efforts have been made heretofore to develop electronic tone-generating systems for simulating the overall tonal quality and response characteristics of conventional musical instruments, and especially of percussion-type instruments such as a piano. Because of the relatively complex envelope characteristic developed in response to the intensity of actuation of a piano or like percussive instrument, it has heretofore been difficult from both a technical and financial standpoint to electronically generate a suitable touch-responsive envelope signal. For example, in the case of a piano, a number of stretched wires are percussively actuated by a hammer, which action produces a tonal envelope which initially reaches a maximum magnitude or intensity rather quickly and thereafter decays at a predetermined or inherent rate until the vibration of the string or strings ceases.

It has been found that the generally exponential charging and discharging characteristics of conventional capacitors provide suitable approximations of both the attack (charging) and the decay (discharging) portions of such an envelope waveshape. However, there has not been provided a suitable control of either the peak level of the envelope or of the time constant of the charging circuit for the capacitive elements in such a system. Such control, as provided by the present invention, permits the peak level of the envelope waveform to vary in accordance with the intensity of actuation of the tone. This permits a broad range of peak intensities of the envelope, giving a "family" of similar attack and decay envelope waveshapes, each having the same attack time and a decay time in accordance with the selected peak value.

OBJECTS AND SUMMARY OF THE INVENTION

It is a general object of the present invention to provide a new and improved touch-responsive envelope control system for an electronic musical instrument.

A more specific object is to provide a touch-responsive envelope control system which is capable of producing a range of peak levels for envelope waveform, in accordance with the intensity of actuation of the associated tone.

A related object is to provide a touch-responsive envelope control system in accordance with the foregoing objects which further varies the time constant and therefore the peak level of an exponential attack waveform in accordance with the intensity of actuation of the associated tone without altering the time intervals for the attack portion of the envelope.

Yet another object is to provide a touch-responsive envelope control system in accordance with the foregoing objects which is relatively simple and inexpensive and yet highly reliable in operation.

Briefly, and in accordance with the foregoing objects, the present invention provides a touch-responsive tonal envelope waveshape control system for an electronic musical instrument which includes tone generating means, keying means and manually actuatable means for initiating the generation and keying of a tone by said generating means and said keying means. The system of the invention comprises a first encoding circuit means responsive to the condition of the manually actuatable means for producing first encoded signal means corresponding to said condition. A second encoding circuit means is provided which is responsive to said first encoded signal means for producing encoded intensity signal means corresponding to the intensity of player actuation of the manually actuatable means. A further circuit means is responsive to said encoded intensity signal means for determining the peak level for the envelope waveshape and for cooperating with the keying means of the instrument for keying the initiated tone from the tone generating means in accordance with a tonal envelope waveshape of the determined peak level, said peak level bearing a predetermined relation to the intensity of player actuation of the instrument.

BRIEF DESCRIPTION OF THE DRAWINGS

Other objects, features, and advantages of the present invention will become more readily apparent upon reading the following detailed description of the illustrated embodiment, together with the accompanying drawings, in which.

DETAILED DESCRIPTION OF THE ILLUSTRATED EMBODIMENT

Figures 1, 2, 3:
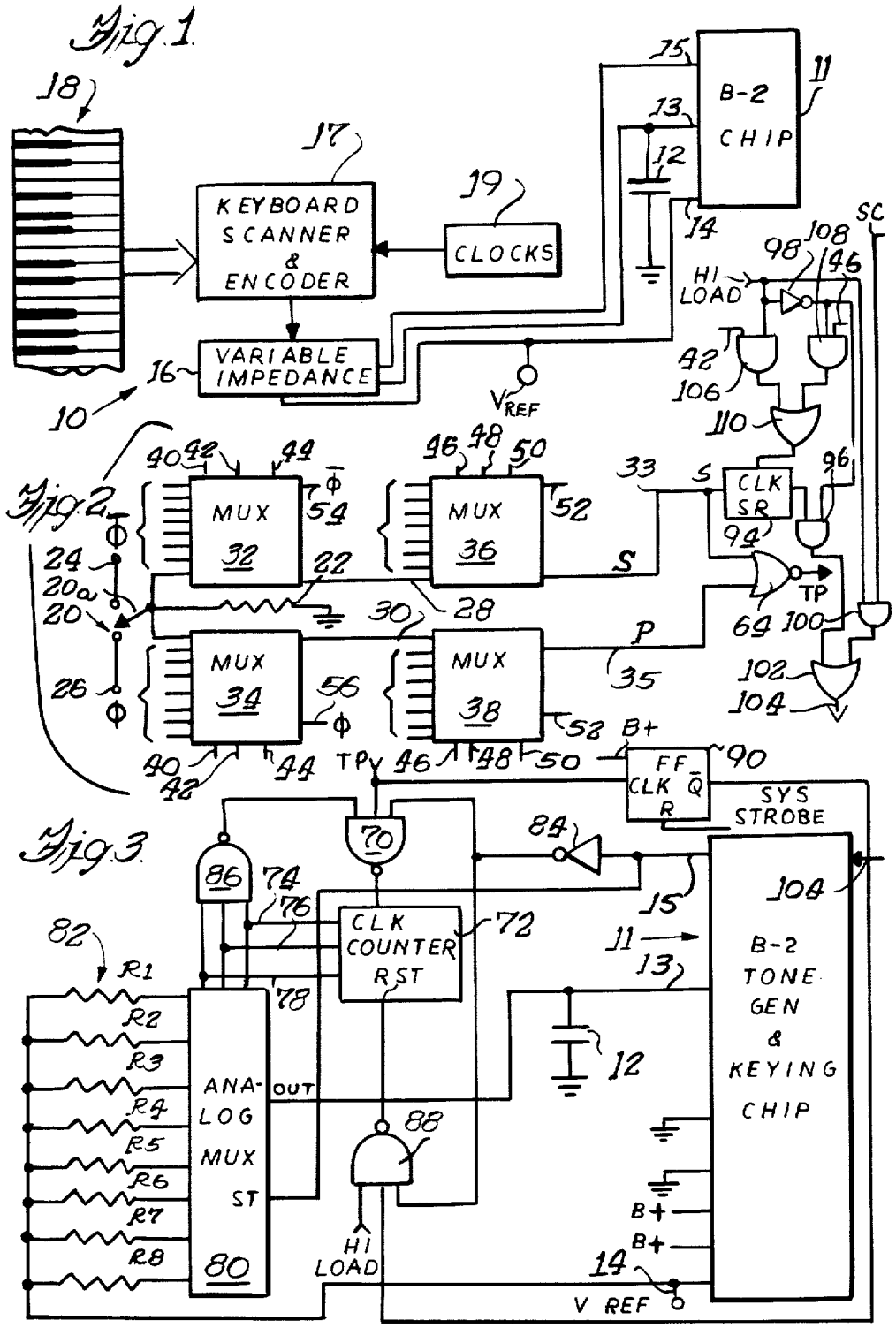
FIG. 1 is a block diagrammatic representation of a system in accordance with the invention.
FIG. 2 is a schematic circuit diagram of a preferred form of a portion of the circuit of the invention.
FIG. 3 is a schematic circuit diagram of a preferred form of the remainder of the circuits of the invention in conjunction with a tone generating and keying circuit.

Referring now to the drawings, and initially to FIG. 1, a circuit 10 according to the invention is illustrated in conjunction with and will be described hereinafter with particular reference to a "B-2" tone generator and keying chip 11 which is more fully described in the copending patent application of Schwartz et al., Ser. No. 917,313. Reference is invited to this copending patent application for a full description of the features and operation of the "B-2" chip. Suffice it to say, for purposes of the present description, that the B-2 chip 11 includes three tone generator circuits, each capable of generating any of the tones actuatable by the player of the electronic musical instrument.

In the case of a keyboard type of electronic musical instrument such as an organ a total of from 44 to perhaps 61 keys may be available for selecting tones on each of one or more keyboards. The B-2 chip 11 also includes three keying circuits or keyers associated with each of the tone generators provided thereon. Additionally a suitable note assignment system is provided, as is more fully described in the above-referenced copending application, for assigning a given tone generator on a given B-2 chip, together with its associated keying circuit or keyer, to electronically reproduce each tone called for by player actuation of a key on the keyboard. Accordingly, while a given tone generator and its associated keyer(s) may be used to sound the actuated note C1, for example, the next time this same C1 note is actuated by the player a different tone generator and its associated keyer may be assigned to produce the tone frequency, depending upon the availability of tone generators in each instance. In one practical and preferred embodiment two of these B-2 chips would be provided for each keyboard of a keyboard-type musical instrument, so as to provide sufficient capacity for the actuation of as many as twelve notes simultaneously. In the prior practice, the envelope waveshape for each note generated by the B-2 chip 11 was determined by an external capacitor coupled to each keying circuit or keyer associated with that tone generator. It will be remembered that the B-2 chip 11 includes three such tone generators, each having three keyers or keying circuits associated therewith. The illustrated evelope capacitor 12 is coupled to one of these keying circuits or keyers at a pin 13 which corresponds to the pin or terminal designated "envelope capacitor 12.5%" in the above-referenced copending application. Briefly, this keying circuit or keyer provides a 12.5% duty cycle tonal wave output, the envelope waveshape thereof being determined by the choice of the capacitor 12 together with a source of changing potential, which is fixed both in value and time duration, and a fixed impedance discharge path internal to the B-2 chip keyer or keying circuit. A further pin or terminal 14 of the B-2 chip 11 receives a reference potential VREF. A final terminal 15 of the B-2 chip 11 utilized in conjunction with the present invention is designated as an "envelope capacitor 50% duty cycle" pin of the B-2 chip 11. As the B-2 chip 11 includes three such tone generators and their associated keying circuits or keyers, three of the circuits 10 of the invention as illustrated in FIG. 1 would be provided for each such B-2 chip, only one such circuit being illustrated for purposes of the present discussion.

The circuit 10 of the invention includes a variable impedance selection circuit 16 which cooperates with the associated keying circuit at the terminal 13 of the B-2 chip 11 and with the capacitor 12 to control the peak amplitude of the resulting tonal envelope waveshape. The reference potential $V_{REF}$ 14 is joined with this variable impedance source 16, as is the terminal 15 of the B-2 chip 11. A keyboard scanner and encoder circuit 17 scans an associated keyboard 18 of the musical instrument for player actuation of a key or keys, and responds to such actuation by providing suitable control signals for the selection of a value of the variable impedance at circuit 16. Suitable clock or timing control signal circuits 19 energize the keyboard scanner and encoder circuit 17.

In operation, the keyboard scanner and encoder circuit 17 is responsive to the condition of each key of the keyboard 18 for producing encoded signals corresponding to this condition. The variable impedance selection circuit 16 includes a second encoding circuit responsive to these encoded signals for producing encoded intensity signals corresponding to the intensity of player actuation of the actuated key or keys of the keyboard 18. The impedance selected by the circuit 16 in response to the encoded intensity signal cooperates with the capacitor 12 and keying portion of the B-2 chip 11, to determine the peak amplitude of the tonal envelope waveshape produced by the B-2 chip 11. Consequently, a tone initiated at the keyboard 18 is keyed from the B-2 chip 11 having a tonal envelope waveshape, the peak amplitude of which bears a predetermined relation of the intensity of player actuation of the instrument.

Referring now also to FIGS. 2 and 3 the circuits of the invention will now be discussed in detail. Moreover, the operation of the invention in response to player actuation of a typical manually actuatable tone initiating means of the instrument, such as a key-operated switch of a conventional keyboard type of electronic musical instrument will be discussed. Such a key-operated switch, designated by the reference numeral 20, is joined with a suitable reference potential such as ground by way of a resistor 22. Essentially, the circuit of FIG. 2 comprises a tri-state encoding system with suitable multiplexing for handling as many as 64 key-operated switches such as the switch 20. Such a tri-state encoding system is illustrated and described, for example, in the copending application of William R. Hoskinson, Ser. No. 06/037,687 filed May 10, 1979 (attorney's docket No. CER 656 TSE), now U.S. Pat. No. 4,207,792.

Briefly, a pair of relatively high frequency control signals $\phi$ and $\overline{\phi}$ are provided on suitable busses 24 and 26 common to all of the key-operated switches 20. The relative phases of these signals $\phi$ and $\overline{\phi}$, together with the application of similar signals to the ensuing circuitry, develop an encoded signal representative of the condition of each key-operated switch such as switch 20. In this regard, each such switch may be in one of three states or conditions of interest: in an undepressed state or condition, in a fully depressed state or condition, or in transition between the undepressed and fully depressed conditions.

In the illustrated embodiment, the encoded state or condition signal comprises a binary, two-bit signal developed on lines 28 and 30. It will be recognized that two binary encoded bits are capable of providing a total of four distinguishable signal states, of which three are of interest and hence utilized here to accomplish the desired "tri-state" encoding of the condition to each key-operated switch 20.

Referring to the circuits intervening between the key-operated switch 20 and the output lines 28 and 30, it will be seen that a pair of multiplexers, designated by reference numerals 32 and 34 are coupled to the key-operated switch 20, and more specifically to movable contactor **20*a* thereof. These multiplexers 32, 34 are arranged for handling as many as 8 keyoperated switches such as the switch 20, and encoding the signals therefrom into an assigned position in time on the output lines 28 and 30. A further pair of multiplexers 36 and 38 receive the lines 28, 30 as well as the similar outputs of seven additional pairs of multiplexers (not shown). Accordingly a 64 note keyboard is accommodated by provision of multiplexers 36, 38, which produce the encoded condition signals for each key switch in an assigned time slot or position on outputs 33 and 35**.

Suitable timing control signals are applied to the control terminals of the multiplexers 32, 34, 36 and 38 to accomplish the desired time encoding of signals from up to 64 key-operated switches as the swtich 20. These lines are designated by reference numerals 40, 42 and 44 and by reference numerals 46, 48, 50 and 52, the signals thereat being further described hereinbelow with reference to FIG. 4. The $\phi$ and $\overline{\phi}$ signals are applied to terminals 54, 56 of multiplexers 32, 34 respectively.

In operation, comparison of the phase of the signal on key-operated switch 20 and more specifically on the movable contactor element 20*a* thereof with the signals $\phi$ and $\overline{\phi}$ at the respective multiplexers 32, 34 produces the tri-state encoded "condition" signal representing the condition of the key-operated switch 20, further encoded in time position, at outputs 28, 30. The multiplexers 36 and 38 then serve in turn to place the resulting logic output on lines 28, 30 into time encoded position in the 64 note keyboard scanning cycle, so as to reproduce the tri-state encoded or binary encoded output for each key-operated switch in time encoded position on the lines 33 and 35. These lines 33 and 35 feed the respective inputs of a two-input NOR gate 64 whose output is designated as the transition pulse (TP). The signals $\phi$ and $\phi$ are such that the output of the NOR gate 64 will be hi or a "transition pulse" only during the scan frame of a key such as key 20 which is in transition between its undepressed and fully depressed states. In the illustrated embodiment, the multiplexers 32, 34, 36 and 38 each comprise an integrated circuit of the type generally designated 74151.

Reference is now invited to FIG. 3, wherein the transition pulses (TP) form one input to a three-input AND gate 70. This NAND gate 70 in turn clocks a counter circuit 72 which counts the transition pulses TP, when allowed at NAND gate 70, as will be explained hereinbelow, and produces a three-bit binary encoded count on its output lines 74, 76 and 78. This three-bit count drives an analog multiplexer 80. In the illustrated embodiment, the analog multiplexer 80 is of the type generally designated 4051, while the counter 72 is of the type generally designated 7493. It will be recognized that the three-bit count developed on the lines 74, 76 and 78 of counter 72 will be proportionate to the number of transition pulses (TP) counted, which in turn are inversely proportional to the intensity or velocity of actuation of an actuated key-operated switch such as the switch 20.

Figure 6:
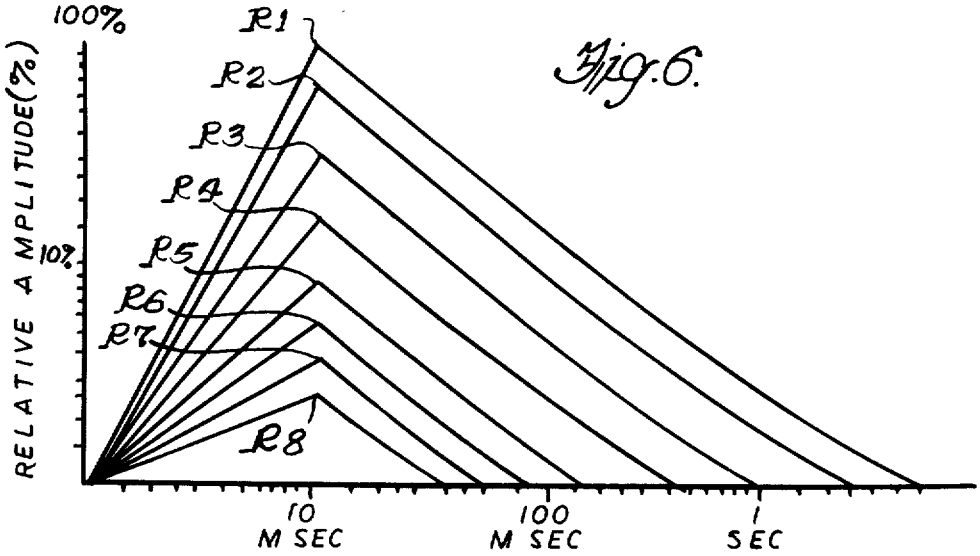
FIG. 6 is a graphic representation, on a logarithmic scale, of exemplary envelope waveforms generated in accordance with the principals of the present invention.

This analog multiplexer 80 acts to couple the "high" side of capacitor 12, which is also its side connected to terminal 13 of the B-2 chip 11, to one side of a selected one of a plurality of resistance elements R1, R2, etc., designated generally by the reference numeral 82. The opposite ends or resistors 82 are tied in common to the reference potential at terminal 14. The analog multiplexer 80 is in effect "addressed" for selection of a resistor 82 by the ultimate count developed at counter 72, as applied to the control inputs thereof on line 74, 76 and 78. The values of these resistance elements 82 are chosen so as to define a peak amplitude or time constant in conjunction with the charging of capacitor 12, which will define an envelope waveshape having a peak amplitude corresponding generally to the intensity of actuation of the associated key-operated switch 20, as represented by the binary count on lines 74, 76 and 78. As this count increases a correspondingly higher value resistor 82 is selected, thus providing a lower amplitude "peak" portion of the resulting envelope waveform, and also varying the time constant of the exponential "attack" portion of the envelope waveform accordingly. It will be noted that the attack time of the circuit is held constant by the action of the B-2 chip 11, being substantially on the order of 12.5 milliseconds in the illustrated embodiment. An exemplary "family" of such exponential attack and decay waveforms is provided by the combination of each of the resistors 82, in turn with the capacitor 12, as illustrated in FIG. 6. The curves of FIG. 6 are approximations only and are not drawn strictly to scale, but are provided merely for illustrating the general principals of operation of the invention.

The clocking of the counter 72 by transition pulses TP is controlled at the NAND gate 70 by the logic states on the remaining two inputs thereof. The first of these inputs receives a signal from the terminal 15 of the B-2 chip 11 via an inverter 84, while the remaining input of the NAND gate 70 receives a signal from the output of a further, similar three-input NAND gate 86. This NAND gate 86 receives its three inputs from the respective lines 74, 76 and 78 which carry the three bit binary output of the counter 72. This latter NAND gate 86 therefore functions as a "maximum count" control for inhibiting the feeding of transition of pulses at NAND gate 70 when the counter 72 has reached its maximum count.

A third three-input NAND gate 88 provides the remaining control function with respect to the counter 72, feeding the reset (RST) input thereof. This NAND gate 88 receives a first of its three inputs from a HI LOAD signal source, to be described later herein, and a second input from the output of the inverter 84. A flip-flop 90 feeds the remaining input of NAND gate 88 from its $\overline{Q}$ output. The transition pulse signal TP feeds the clock input (CLK) of this flip-flop 90 while a system strobe signal feeds the reset input (R) thereof. This system strobe signal is a clock or timing control signal, developed in conjunction with the B-2 chip, as more fully described in the above-referenced Schwartz et al copending application.

Referring again to FIG. 2, the binary encoded output line 33 also feeds a 64-bit shift register (SR) 94, whose output is delivered to one input of a two-input AND gate 96. The remaining input of AND gate 96 is fed from the HI LOAD line via an inverter 98. The AND gate 96 and a second, similar two-input AND gate 100, feed the respective inputs of a two-input OR gate 102, whose output feeds a serial data control input line 104 to the B-2 chip 11 of FIG. 3. Accordingly, the serial data input to the B-2 chip 11 is fed by the circuit of FIG. 2, rather than in the fashion described in the above-referenced copending application (Schwartz et al, Ser. No. 917,313). The AND gate 100 receives its respective inputs from the HI LOAD line and from a switch control data line SC. This SC line carries signals more fully described in the above-referenced copending application.

The clock input (CLK) of the shift register 94 is controlled by the clock or timing signals on the lines 42 and 46 and by the HI LOAD control signal via a network comprising AND gates 106 and 108 and OR gate 110. The AND gate 106 receives the HI LOAD signal and the signal on line 142, while the AND gate 108 receives the signal on the line 46 and the HI LOAD signal inverted through the inverter 98. The OR gate 110 receives the outputs of AND gates 106 and 108 and feeds its output to the clock input of shift register 94.

The foregoing circuits provide a suitable timing or synchronization signal at the line 104 to insure that the tone generator on the B-2 chip which is assigned, as described above, for producing a particular actuated note which corresponds to the peak amplitude selection circuit 16 activated for the same note. This concurrent assignment of circuits results in a synchronization of the selection of a particular tone generator on a B-2 chip 11 with selection of the particular one of the circuits 10 of FIG. 3 associated with the tone generator. In the illustrated embodiment, the multiplexer scan of the keyboard proceeds at eight times the rate of generator assignment at the B-2 chip. Hence, the 64 bit shift register 94 and associated elements effectively "slow down" the key condition data train on line 33 to a serial data train eight times slower for feeding the B-2 chip. The 64 bit shift register width therefore allows "storage" of all key condition data for eight scans of eight keys.

The operation of the B-2 chip in response to this "serial data" input is more fully described in the above-referenced copending application.

Figure 4:
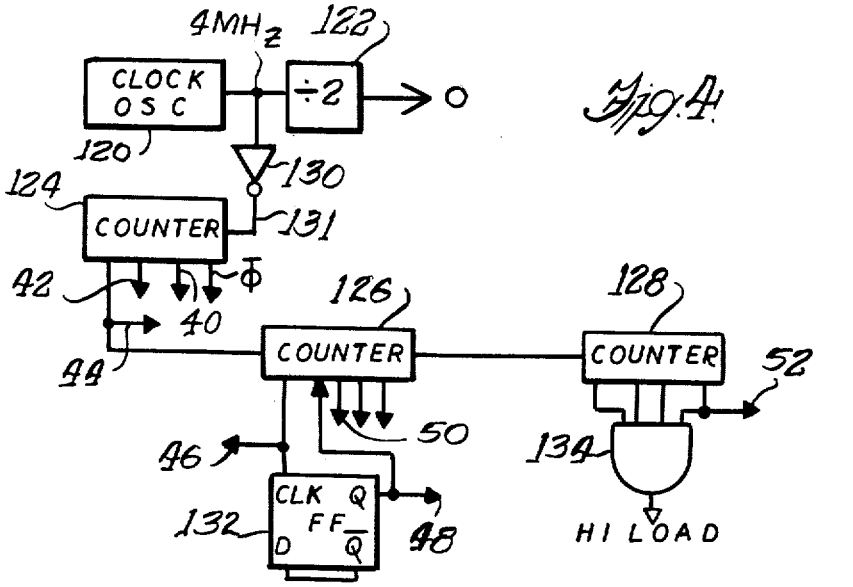
FIG. 4 is a schematic circuit diagram of a clock oscillator and counter chain for providing suitable timing control signals for the circuits of the invention.
Figure 5:
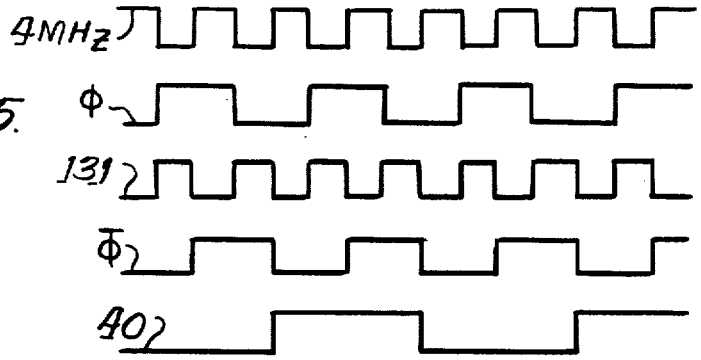
FIG. 5 is a waveform diagram illustrating some of the timing control signals generated by the circuit of FIG. 4.

Referring now to FIGS. 4 and 5 a suitable clock oscillator 120 provides, in the illustrated embodiment, a 4 megahertz 50% duty cycle or square wave output. The $\phi$ signal is derived from a divide-by-two circuit 122 fed from the oscillator 120. The remaining control signals utilized in the circuits of FIGS. 2 and 3 are derived from the counter chain fed from the clock oscillator 120 and comprising counters 124, 126 and 128. This counter chain is fed by way of an inverter 130 interposed in the output of the clock oscillator 120. The counters 124, 126 and 128 each comprise, in the illustrated embodiment a four bit binary counter of the type generally designated 7493, whereby the successive outputs thereof each provide a 50% duty cycle square wave output divided by successive powers of two from the 4 megahertz output of the clock oscillator 120.

Specifically, the counter 124 provides the $\overline{\phi}$ signal and the control signals 40, 42 and 44 which latter three signals are, in the illustrated embodiment, substantially on the order of 1 megahertz, 500 kilohertz and 250 kilohertz. Similarly, the counter 126 provides the timing or control signals 46, 48 and 50 which in the illustrated embodiment comprise signals at 125 kilohertz, 62.5 kilohertz and 31.25 kilohertz, respectively. A flip-flop 132 is interposed between the first output and the second input of counter 126 to obtain suitable division for obtaining the signals 48 and 50. The counter 128 provides the signal 52 at its last output, which in the illustrated embodiment is at a frequency of 438 hertz. The four outputs of this counter 128 feed the respective inputs of a four-input AND gate 134, whose output forms the HI LOAD signal line mentioned above.

Briefly, in operation, the invention utilizes a "transition period" being the time measured during actuation of a key-operated switch such as the switch 20 between its undepressed position and its fully depressed position. These two positions correspond, respectively, to the key switch being in contact with the busses 24 and 26. Since the same signals $\phi$ and $\overline{\phi}$ at the busses 24 and 26 are also used to strobe the respective multiplexers 32 and 34, their outputs 28 and 30 are in effect similar to the outputs of a phase comparator. The multiplexing of key-operated switches by multiplexers 32 and 34 is done at a sufficiently high rate to in effect allow detection of the state of an actuated key at least eight times before the assignment of any tone generators on the B-2 chip to the actuated key. This concept of B-2 chip assignment is more fully described in the above-referenced copending application of Schwartz et al, Ser. No. 917,313.

If a key-operated switch such as switch 20 is in transition, that is, en route from the buss 24 to the buss 26, both lines 28 and 30 go to a logic 0 and hence lines 33 and 35 also go to logic 0 when that key-operated switch is being multiplexed through multiplexers 32, 34, 36 and 38. This logic condition in turn causes a logic 1 to be transmitted on the transition pulse line TP. Consequently, at each scan of the key-operated switch 20 a high or logic 1 transition pulse will be produced at the line TP, clocking the counter 72 and thus increasing the binary encoded output thereof on the lines 74, 76 and 78 by one least significant bit.

It will be recalled that in a preferred form, two or three such B-2 chips 10 each bearing three tone generators are utilized for each keyboard of the electronic musical instrument. Accordingly, at least twelve circuits similar to the circuit 16, each including a counter (e.g., 72) and an analog multiplexer (e.g., 80) are provided, one such circuit (e.g., 16) being associated with each tone generator. The same transition pulse signal TP feeds all twelve of these circuits, and consequently upon a first-actuated key (and before a subsequent key actuation) all twelve counters accumulate the transition pulse count from that key on successive scans of the keyboard. Moreover, the flip-flop 90 toggles on these transition pulses thereby inhibiting reset of the respective counters 72 at least until the end of generator assignment. Simultaneously, however, the serial data on line 104 is read into the B-2 chip 11, resulting ultimately in generator assignment at which point the pin 15 associated with the assigned generator goes immediately to a logic 1, thereby inhibiting further signals to either the clock or reset pins of only the counter 72 associated with that tone generator, by way of the AND gates 70 and 88 associated with that counter 72. The remaining counters, whose associated generators have not been assigned to an actuated key will at this point be reset and available for the reception of transition pulses on line TP from other actuated keys. During the time that the line 15 is high, indicating assignment of tone generator, the analog multiplexer 80 is also strobed thereby, in effect coupling the selected one of the resistors 82 to the capacitor 12 to determine the peak amplitude for that envelope waveshape. Selection of one of these resistors 82 controls both the peak amplitude and the shape of the attack and decay portions of the exponential waveform, as generally indicated by the waveform diagrams of FIG. 6.

Referring briefly to FIG. 6, a family of curves (illustrated as a log-log graph) shows the effect on the envelope waveform of selection of different ones of the resistors 82. These curves are designated R1 through R8 in accordance with the one of the resistors 82 whose selection results in that curve. For purposes of illustration, TABLE I below shows exemplary values of the resistors 82 in Ohms, together with the relative amplitudes in percents, of the peaks of the associated curves of FIG. 6.

TABLE I

| Resistor # | Value (Ohms) | Relative Peak Amplitude (%) |
|---|---|---|
| R1 | 2.7k | 99% |
| R2 | 27k | 65% |
| R3 | 82k | 32% |
| R4 | 180k | 16% |
| R5 | 360k | 8.5% |
| R6 | 560k | 5.5% |
| R7 | 820k | 3.8% |
| R8 | 1.2m | 2.6% |

In the foregoing exemplary embodiment, the dynamic range thus achieved by the given selection of resistor values of the resistor 82 is substantially on the order of 31.5 db.

While a preferred embodiment has been illustrated and described herein the invention is not limited thereto. On the contrary, modifications, changes and alternatives may suggest themselves to those skilled in the art upon reading the foregoing descriptions. Accordingly, the invention is intended to include any such changes, modifications or alternatives insofar as they fall within the spirit and scope of the appended claims.

The invention is claimed as follows:

1. A touch responsive tonal envelope waveshape control system for an electronic musical instrument including tone generating means, keying means and manually actuatable means for initiating the generation and keying of a tone by said generating means and keying means, said system comprising: two contacts, means for producing a signal of predetermined but different phase at each of said two contacts, said manually actuatable means being movable between said two contacts for receiving one or neither of said two signals, phase comparison and encoding circuit means responsive to the signal condition of said manually actuatable means for producing first encoded signals corresponding to said condition, second encoding circuit means responsive to said first encoded signals for producing an encoded intensity signal corresponding to the intensity of player actuation of said manually actuatable means and amplitude control circuit means responsive to said encoded intensity signal and cooperative with said keying means for controlling the peak amplitude of the tonal envelope waveshape, thereby keying the initiated tone from said generating means having a tonal envelope waveshape having a peak amplitude which bears a predetermined relation to the intensity of player actuation of the instrument.

2. A system according to claim 1 wherein said manually actuatable means comprises a plurality of player actuatable means, said tone generating means comprises a plurality of tone generators each capable of generating a signal corresponding to any note of said electronic musical instrument selectable by said player actuatable means and said keying means comprises a plurality of keyers, selected ones of said plurality of keyers being associated with selected ones of said plurality of tone generators, wherein said electronic musical instrument further includes means for assigning one of said tone generators and one of said keyers for producing each tone initiated by each player actuation of one said player actuatable means, and wherein said tonal envelope waveshape control system further includes a plurality of said amplitude control circuit means, one for each tone generator means of said electronic musical instrument and assignment circuit means for assigning control of the peak amplitude for each actuated one of the player actuatable means to the amplitude control circuit means associated with the tone generator assigned to that player actuatable means for that actuation thereof.

3. A system according to claim 1 or claim 2 wherein said manually actuable means comprise keys of a keyboard-type electronic musical instrument and wherein said phase comparison and encoding circuit means comprises a tri-state encoding circuit means for producing a first signal state when one of said keys is in its undepressed condition, for producing a second signal state upon initial movement of said key away from its depressed condition and for producing a third signal state in response to the associated key being in a fully depressed position, said first, second and third signal states comprising said first encoded signals.

4. A system according to claim 3 wherein said amplitude control circuit means includes means responsive to said tri-state encoder circuit for initiating control of the peak amplitude in response to the transition in the first encoded signals from said first signal state to said second signal state.

5. A system according to claim 3 wherein said amplitude control circuit means includes means for initiating control of the peak amplitude in response to the transition in the first encoded signals from said second signal state to said third signal state.

6. A system according to claim 1 or claim 2 wherein said phase comparison and encoding circuit means further includes multiplexer means for continuously and repeatedly scanning said player actuatable means and producing said first encoded signals further encoded in a predetermined time frame reference.

7. A system according to claim 1 or claim 2 wherein said second encoding circuit means comprises counter means operatively coupled for receiving said first encoded signals and for producing a digitally encoded count representative of the intensity of actuation of the associated manually actuatable means.

8. A system according to claim 1 or claim 2 wherein said amplitude control circuit means comprises a plurality of impedance elements of selected values and analog multiplexer means coupled to said keying means and to said plurality of impedance elements and responsive to said encoded intensity signal for selecting and coupling one of said impedance elements in circuit with said keying means.

9. A system according to claim 2 wherein said assignment means includes shift register means coupled between said phase comparison and encoding circuit means and said tone generators.

10. A tonal envelope waveshape control circuit for use with an electronic musical instrument of the keyboard variety for selecting a time constant for the tonal envelope of an actuated tone in accordance with the relative intensity of actuation of a key of said keyboard instrument associated with said tone, wherein said musical instrument includes a plurality of tone generators and a plurality of keyers, each tone generator having predetermined ones of said keyers operatively associated therewith, said control circuit comprising: tri-state encoding circuit means associated with each key for producing a digitally encoded signal having a first signal state when the associated key is in its undepressed position, a second signal when said associated key is in its fully depressed position and a third signal state when said associated key is in transition between said undepressed and said fully depressed positions, counter circuit means responsive to said first, second and third signal states for producing a digitally encoded count representative of the intensity with which the associated key is actuated, a plurality of impedance elements of selected values, and analog multiplexer means driven by said counter means and coupled to said impedance elements and to selected ones of said keyers for selecting one of said elements in accordance with the digitally encoded count and applying the selected element to said keyer thereby effectively determining the time constant of the envelope waveshape produced thereby.

11. A touch responsive tonal envelope waveshape control system for an electronic musical instrument including tone generating means, keying means and manually actuatable means for initiating the generation and keying of a tone by said generating means, said keying means normally producing an exponential tonal envelope waveshape having a fixed time constant, said system comprising phase comparison and encoding circuit means responsive to the condition of said manually actuatable means for producing first encoded signals corresponding to said condition, second encoding circuit means responsive to said first encoded signals for producing an encoded intensity signal corresponding to the intensity of player actuation of manually actuatable means, and further circuit means responsive to said encoded intensity signal for selecting a time constant for an exponential tonal envelope waveshape and for cooperating with said keying means for imparting to the initiated tone from said tone generating means an exponential tonal envelope waveshape of the selected time constant, said time constant being representative of the intensity of player actuation of the instrument.

12. A touch responsive tonal envelope waveshape control system for an electronic musical instrument including tone generating means, keying means and manually actuatable means for initiating the generation and keying of a tone by said generating means and keying means, said system comprising: two contacts, means for producing a signal of predetermined but different phase at each of said two contacts, said manually actuable means being movable between said two contacts for receiving one or neither of said two signals, phase comparison and encoding circuit means responsive to the signal condition of said manually actuatable means for producing encoded intensity signals corresponding to the intensity of player actuation of said manually actuatable means, and peak amplitude determining circuit means responsive to said encoded intensity signals and cooperative with said keying means for controlling the peak amplitude of the tonal envelope waveshape keyed by said keying means, thereby keying an initiated tone from said tone generating means having a tonal envelope waveshape of a peak amplitude which bears a predetermined relation to the intensity of player actuation of the instrument.

13. A system according to claim 12 wherein said keying means is responsive to the value of an impedance in circuit therewith for determining the peak amplitude of the envelope waveshape produced, and wherein said amplitude control circuit means includes means for providing an impedance which varies in accordance with the intensity of player actuation of the instrument and means for selectively coupling said variable impedance in circuit with said keying means so as to determine the peak amplitude of the envelope waveshape produced thereby.

14. A touch responsive tonal envelope waveshape control system for an electronic musical instrument including tone generating means and associated keying means responsive to a manually actuable tone initiation means for generating and keying a corresponding tone, said system comprising: tow contacts, means for producing a signal of predetermined but different phase at each of said two contacts, said manually actuatable means being movable between said two contacts for receiving one or neither of said two signals, phase comparison and encoding circuit means responsive to the signal condition of said manually actuatable means for producing encoded signals corresponding to the intensity of player actuation of said manually actuatable means and peak amplitude control circuit means responsive to said encoded intensity signals and cooperative with said keying means for controlling the peak amplitude of the tonal envelope waveshape produced in response to said player actuation.

* * * * *